US009966179B2

(12) United States Patent
Kim et al.

(10) Patent No.: US 9,966,179 B2
(45) Date of Patent: May 8, 2018

(54) COMMON MODE FILTER FOR IMPROVING MAGNETIC PERMEABILITY AND HIGH FREQUENCY CHARACTERISTICS

(71) Applicant: SAMSUNG ELECTRO-MECHANICS CO., LTD., Suwon-si, Gyeonggi-do (KR)

(72) Inventors: Chin Mo Kim, Suwon-si (KR); Jung Wook Seo, Suwon-si (KR); Eun Hye Na, Suwon-si (KR); Hak Kwan Kim, Suwon-si (KR); Hyung Jin Jeon, Suwon-si (KR); Sung Yong An, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 61 days.

(21) Appl. No.: 15/099,921

(22) Filed: Apr. 15, 2016

(65) Prior Publication Data

US 2016/0307687 A1 Oct. 20, 2016

(30) Foreign Application Priority Data

Apr. 16, 2015 (KR) ..... 10-2015-0054038

(51) Int. Cl.
*H01F 27/255* (2006.01)
*H01F 17/00* (2006.01)
*H01F 1/34* (2006.01)

(52) U.S. Cl.
CPC ..... *H01F 27/255* (2013.01); *H01F 17/0013* (2013.01); *H01F 1/348* (2013.01); *H01F 2017/0093* (2013.01)

(58) Field of Classification Search
None
See application file for complete search history.

(56) References Cited

U.S. PATENT DOCUMENTS

| | | | | |
|---|---|---|---|---|
| 4,728,554 | A * | 3/1988 | Goldberg | H01Q 15/24 156/63 |
| 5,424,698 | A * | 6/1995 | Dydyk | H01P 1/218 333/202 |
| 7,141,311 | B2 * | 11/2006 | Takada | C01G 49/0018 427/131 |
| 2009/0295526 | A1 * | 12/2009 | Mikami | C01G 49/009 336/196 |
| 2010/0156733 | A1 * | 6/2010 | Kato | H01Q 1/243 343/787 |

(Continued)

FOREIGN PATENT DOCUMENTS

| | | | |
|---|---|---|---|
| JP | 61-42731 | A | 3/1986 |
| JP | 5-29129 | A | 2/1993 |

(Continued)

OTHER PUBLICATIONS

Korean Office Action issued in Korean Application No. 10-2015-0054038 dated May 11, 2016, with English Translation.

*Primary Examiner* — Kevin M Bernatz
(74) *Attorney, Agent, or Firm* — McDermott Will & Emery LLP

(57) ABSTRACT

A common mode filter includes a magnetic substrate in which ferrite particles having anisotropy and a planar structure are disposed to have a planar orientation.

10 Claims, 7 Drawing Sheets

(56) References Cited

U.S. PATENT DOCUMENTS

| | | | | |
|---|---|---|---|---|
| 2012/0119863 | A1* | 5/2012 | Wu | H01F 17/0013 336/192 |
| 2016/0167978 | A1* | 6/2016 | Christensen | B08B 9/032 423/594.2 |
| 2017/0169921 | A1* | 6/2017 | Hill | H01F 1/0306 |

FOREIGN PATENT DOCUMENTS

| | | | |
|---|---|---|---|
| JP | 2005-306696 | A | 11/2005 |
| WO | 2007111122 | A1 | 10/2007 |

* cited by examiner

210

220

230

240

COMMON MODE FILTER FOR IMPROVING MAGNETIC PERMEABILITY AND HIGH FREQUENCY CHARACTERISTICS

CROSS-REFERENCE TO RELATED APPLICATION

This application claims the benefit of priority to Korean Patent Application No. 10-2015-0054038, filed on Apr. 16, 2015 with the Korean Intellectual Property Office, the entirety of which is incorporated herein by reference.

TECHNICAL FIELD

The present disclosure relates to a common mode filter.

BACKGROUND

As the speeds and the multifunctionalization of electronic devices have increased, interfaces for high speed data transmissions have increased in use, while the operating frequencies of elements have also gradually increased. In general, many elements used in high frequency operations are operated in both a differential mode and a common mode. The above-mentioned elements may usually be found in a high speed interface such as a digital visual interface (DVI), a high-definition multimedia interface (HDMI), a low voltage differential signaling (LVDS) interface, and a display port (DP) interface, including a universal serial bus (USB) interface.

The above-mentioned elements create differential mode noise in a differential mode in which directions of an input signal are opposite to each other and common mode noise in a common mode in which the directions of the input signal are the same as each other, as two types of conductive noise between a ground and a cable of an operating element during operations. Here, a common mode filter (CMF) element, a filter for removing common mode noise, may be an element allowing a differential mode signal to be transferred and a common mode signal to be blocked. A general common mode filter element may block the common mode noise using impedance (alternating current resistance). Here, impedance may be associated with the magnetic permeability of a magnetic material, and, in order to develop a common mode filter element operated at a high frequency, a high frequency material may be required.

The common mode filter may be configured to include a magnetic layer, a non-magnetic insulating layer, a coil conductor disposed in the non-magnetic insulating layer, a lead terminal wire, and an external electrode connected to the lead terminal wire.

SUMMARY

An aspect of the present disclosure provides a common mode filter having high magnetic permeability and low loss characteristics even at a high frequency, such as a frequency within the GHz band, by improving high frequency characteristics using ferrite particles having a uniform size and planar magnetic anisotropy such as hexaferrite particles.

According to an aspect of the present disclosure, a common mode filter includes a magnetic substrate in which ferrite particles having anisotropy and a planar structure have planar magnetic anistropy.

The ferrite particles may include hexaferrite particles having a plate shape, and the magnetic characteristics of the ferrite particles may be determined depending on an arrangement of the hexaferrite particles having the plate shape in the magnetic substrate.

At least one of magnetic permeability and a resonance frequency may be adjusted by adjusting at least one of a size, a length, and the planar structure of the ferrite particles.

The planar magnetic anisotropy of the ferrite particles may be oriented in at least one of a vertical direction and a horizontal direction of the magnetic substrate.

According to another aspect of the present disclosure, a common mode filter includes a magnetic substrate in which a permanent magnet having anisotropy and a planar structure has planar magnetic anisotropy.

According to another aspect of the present disclosure, a common mode filter may include: a coil part including an insulating layer and a conductor pattern formed in the insulating layer; and a magnetic substrate coupled to one surface or both surfaces of the coil part, wherein the magnetic substrate is provided with ferrite particles having anisotropy and a planar structure.

The magnetic substrate coupled to the top of the coil part to configure an upper plate may include ferrite particles disposed horizontally in an upper portion of the upper portion of the magnetic substrate, and may further include ferrite particles disposed vertically in a lower portion of the upper portion of the magnetic substrate.

The magnetic substrate coupled to the bottom of the coil part to configure a lower plate may include ferrite particles inserted in a vertical direction of the magnetic substrate in an upper side thereof, and may further include ferrite particles inserted into a lower end of the ferrite particles inserted in the vertical direction in a horizontal direction of the magnetic substrate.

BRIEF DESCRIPTION OF DRAWINGS

The above and other aspects, features and other advantages of the present disclosure will be more clearly understood from the following detailed description taken in conjunction with the accompanying drawings.

DETAILED DESCRIPTION

Figure 1:
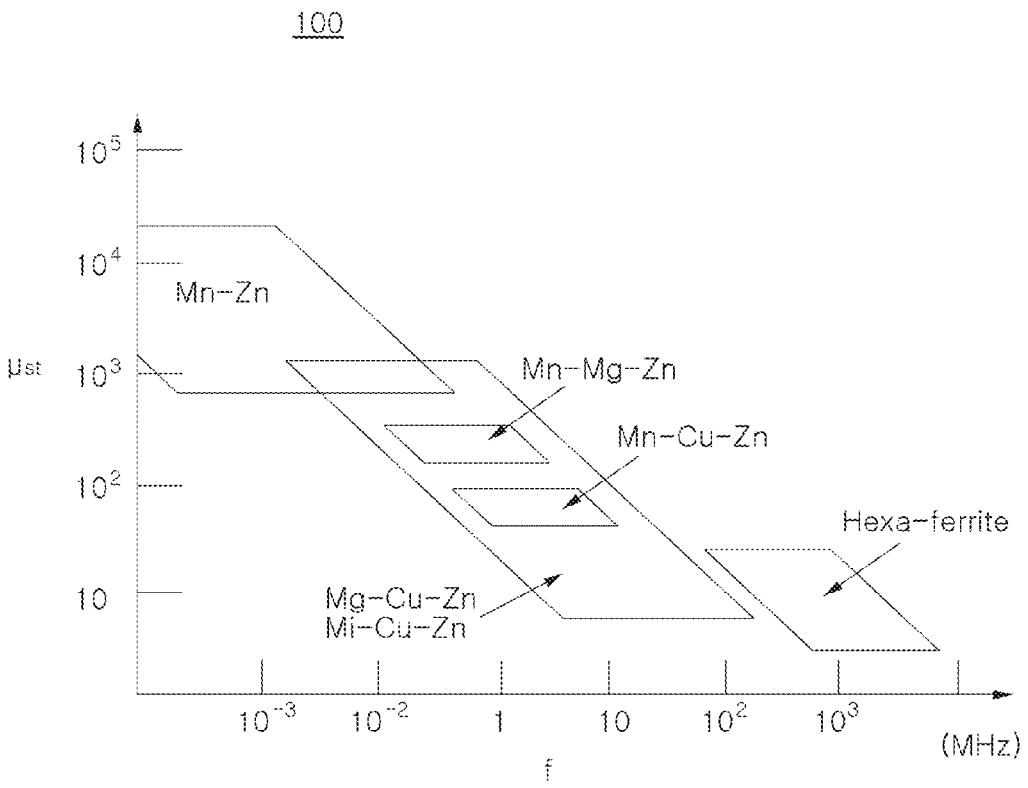
FIG. 1 is a graph illustrating magnetic permeability characteristics of hexaferrite particles having a plate shape.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship relative to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

The following exemplary embodiments relate to a common mode filter capable of performing a noise filtering effect very well, even at high frequencies, by improving high frequency characteristics, and a magnetic substrate included in the common mode filter.

As an example, the common mode filter may include a magnetic substrate in which ferrite particles having anisotropy, disposed to have a planar structure, or a magnetic substrate in which hexaferrite particles having a plate shape are disposed to have the planar magnetic anisotropy. Here, the ferrite particles (or a permanent magnet) may have anisotropy depending on an arrangement of the ferrite particles (or the permanent magnet), and at least one of magnetic permeability and resonance frequency may be adjusted by adjusting at least one of a size, a length, and an orientation of the ferrite particles (or the permanent magnet).

For example, the planar magnetic anisotropy possessed by the ferrite particles (or the permanent magnet) may include at least one of being oriented in a vertical direction and a horizontal direction of the magnetic substrate.

FIG. 1 is a graph illustrating magnetic permeability characteristics of hexaferrite particles having a plate shape.

In a graph 100, an x axis may show a frequency and a y axis may show magnetic permeability, wherein the graph 100 may show that the hexaferrite particles have relatively higher magnetic permeability and lower loss in a high frequency band such as a frequency band of GHz as compared to the spinel-ferrite.

FIGS. 2A to 2D are views illustrating an example of the hexaferrite particles having the plate shape.

Figure 2A:
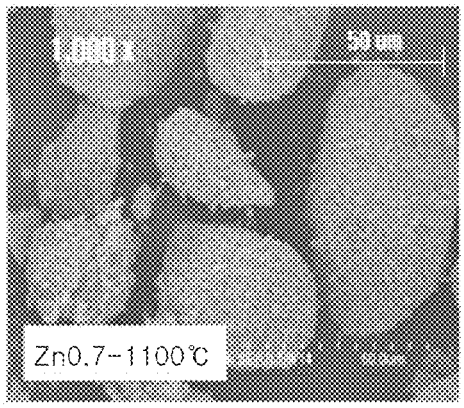
FIGS. 2A, 2B, 2C and 2D are views illustrating examples of hexaferrite particles having the plate shape.
Figure 2B:
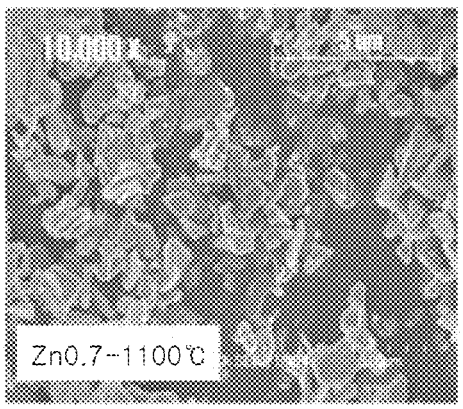
Figure 2C:
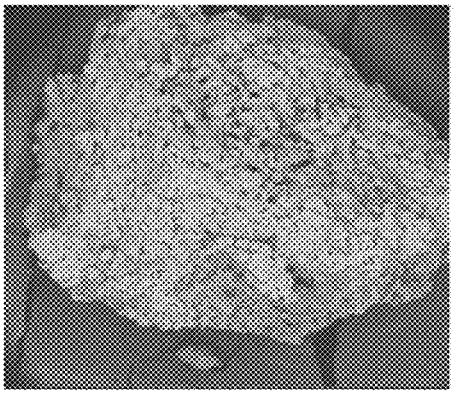
Figure 2D:
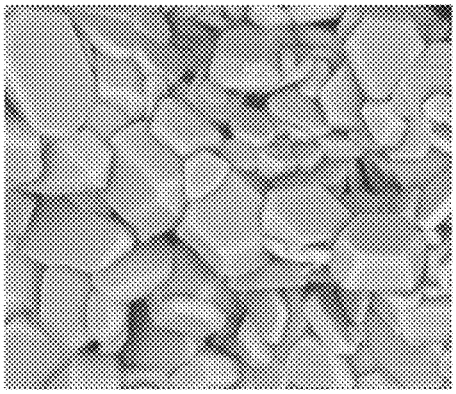

In FIGS. 2A and 2B, two electron microscope photographs 210 and 220 illustrate examples of $Fe_2O_3$ having particles which are aggregate forms but are not uniform. In FIGS. 2C and 2D, two electron microscope photographs 230 and 240 illustrate examples of FeOOH having particles which are aggregate forms and are uniform.

Since the above-mentioned hexaferrite particles have low loss characteristics and high magnetic permeability at high frequency (e.g., the band of GHz), when the hexaferrite particles are used, a common mode filter having better attenuation characteristics at the high frequency in the common mode while having low loss characteristics may be provided.

Figure 3:
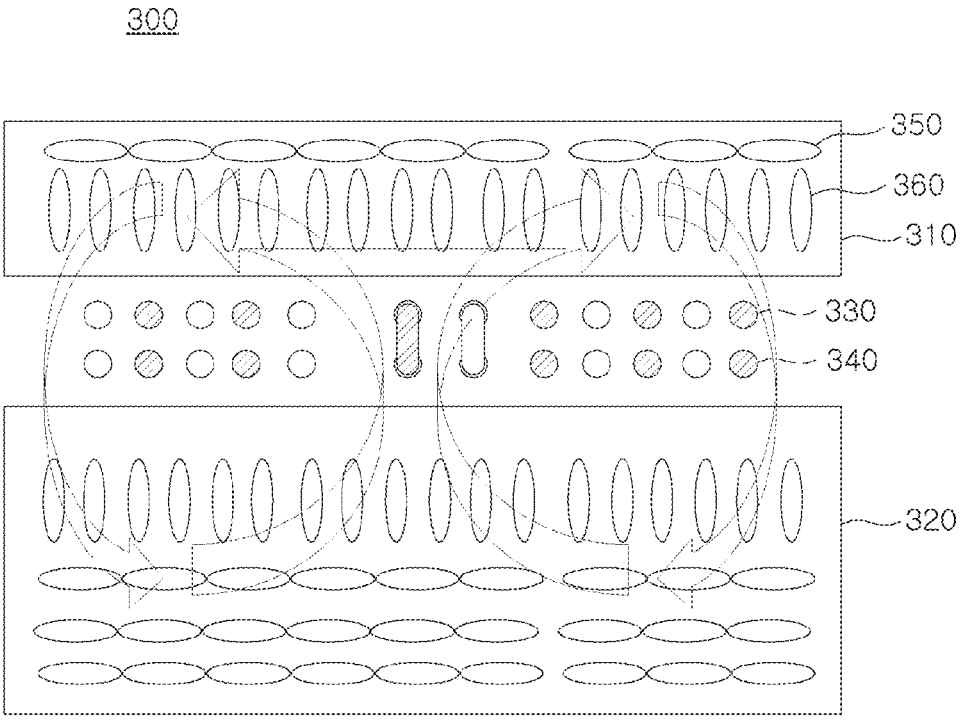
FIG. 3 is a cross-sectional view illustrating a common mode filter according to an exemplary embodiment in the present disclosure.
Figure 4:
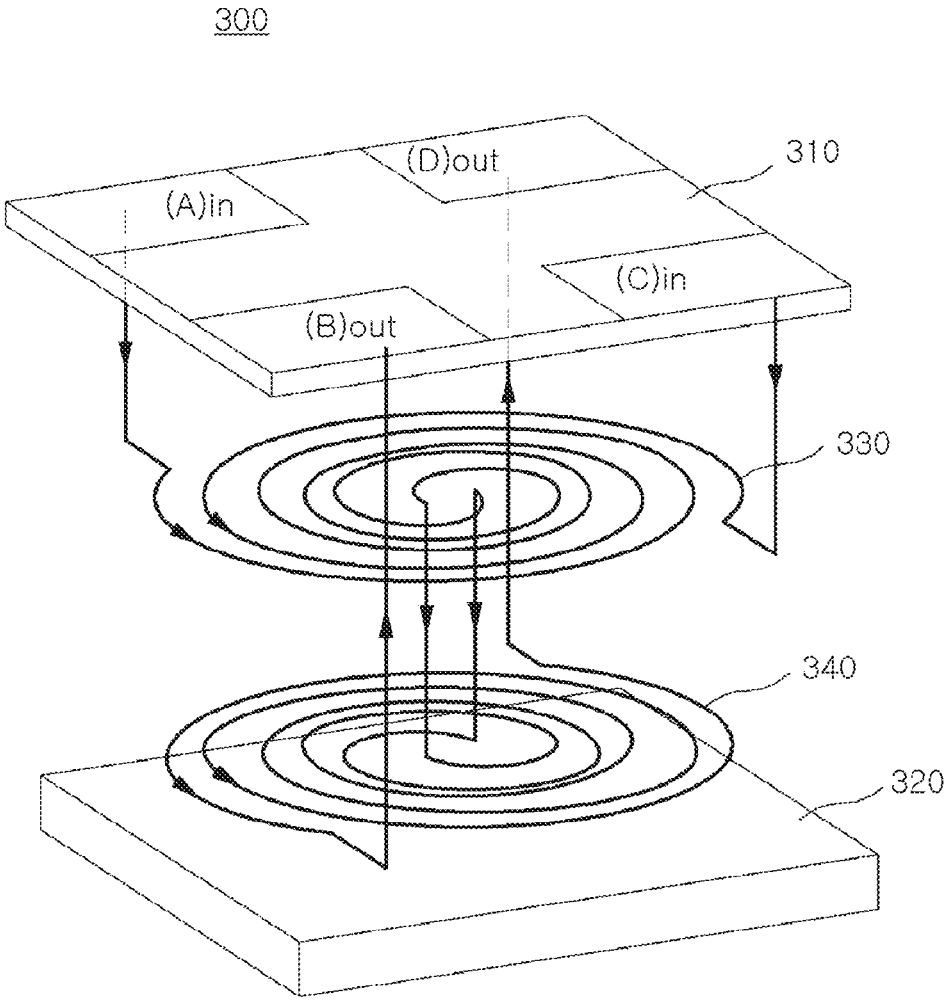
FIG. 4 is an exploded perspective view illustrating the common mode filter according to an exemplary embodiment in the present disclosure.

FIG. 3 is a cross-sectional view illustrating a common mode filter according to an exemplary embodiment in the present disclosure, and FIG. 4 is an exploded perspective view illustrating the common mode filter according to an exemplary embodiment in the present disclosure.

A common mode filter 300 illustrated in FIGS. 3 and 4 illustrates an example in which two magnetic substrates in which ferrite particles having anisotropy, disposed to have a planar structure, configure an upper plate 310 and a lower plate 320, respectively. The upper plate 310 and the lower plate 320 may be coupled to an insulator, and an upper side surface and a lower side surface of a coil part including a conductor pattern (a primary coil 330 and a secondary coil 340) formed in the insulator.

Here, both ends of the primary coil 330 may be connected to two input terminals (A) in and (C) in, respectively, and both ends of the secondary coil 340 may be connected to two output terminals (B) out and (D) out, respectively.

In addition, as described above, the ferrite particles inserted into the magnetic substrate may include the hexaferrite particles having the plate shape, byway of example. In this case, planar magnetic anisotropy of the ferrite particles may be formed depending on the arrangement of the hexaferrite particles having the plate shape.

For example, the exemplary embodiment of FIG. 3 illustrates an example in which ferrite particles (e.g., hexaferrite particles 350) having planar magnetic anisotropy and oriented in a horizontal direction with the magnetic substrate and ferrite particles (e.g., hexaferrite particles 360) having planar magnetic anisotropy and oriented in a vertical direction with the magnetic substrate are inserted into the magnetic substrates. The above-mentioned hexaferrite particles 350 and 360 may have a size of 50 μm or less, by way of example.

The ferrite particles inserted into the magnetic substrate may forma magnetic field around the conductor pattern, as current flows in the conductor pattern (the primary coil 330 and the secondary coil 340). The magnetic field generated from the conductor pattern formed in a plurality of layers may be overlapped (or canceled in a differential mode) to form the magnetic field. Magnetic flux of the formed magnetic field may flow along the upper plate 310 and the lower plate 320.

The planar magnetic anisotropy of the ferrite particles included in the magnetic substrates of the upper plate 310 and the lower plate 320 may serve as a passage by which the magnetic flux may better flow, thereby significantly reducing radiation of the magnetic field to the outside. As a result, loss in a common mode may be reduced, and consequently, attenuation characteristics of a common mode filter 300 at the high frequency may be improved.

The exemplary embodiment of FIG. 3 illustrates an example in which the ferrite particles are inserted into the top of a magnetic sheet configuring the upper plate 310 so as to have planar magnetic anisotropy oriented in a horizontal direction of the magnetic sheet, and the ferrite particles are inserted into a lower end thereof so as to have planar magnetic anisotropy oriented in a vertical direction of the magnetic sheet, as an arrangement of the ferrite particles for forming the passage of the above-mentioned magnetic field. In addition, the exemplary embodiment of FIG. 3 illustrates an example in which the ferrite particles are inserted into the upper end of the magnetic sheet configuring the lower plate 320 so as to have planar magnetic anisotropy oriented in the vertical direction of the magnetic sheet, and the ferrite particles are inserted into the lower end thereof so as to have planar magnetic anisotropy oriented in the horizontal direction of the magnetic sheet.

The exemplary embodiment of FIG. 3 is merely an example, and since at least one of magnetic permeability and a resonance frequency may be variously adjusted by adjusting sizes, lengths, and orientation of the ferrite particles, it may be understood that there may be various exemplary embodiments according to the sizes, the lengths, and the orientations of the ferrite particles.

Figure 5B:
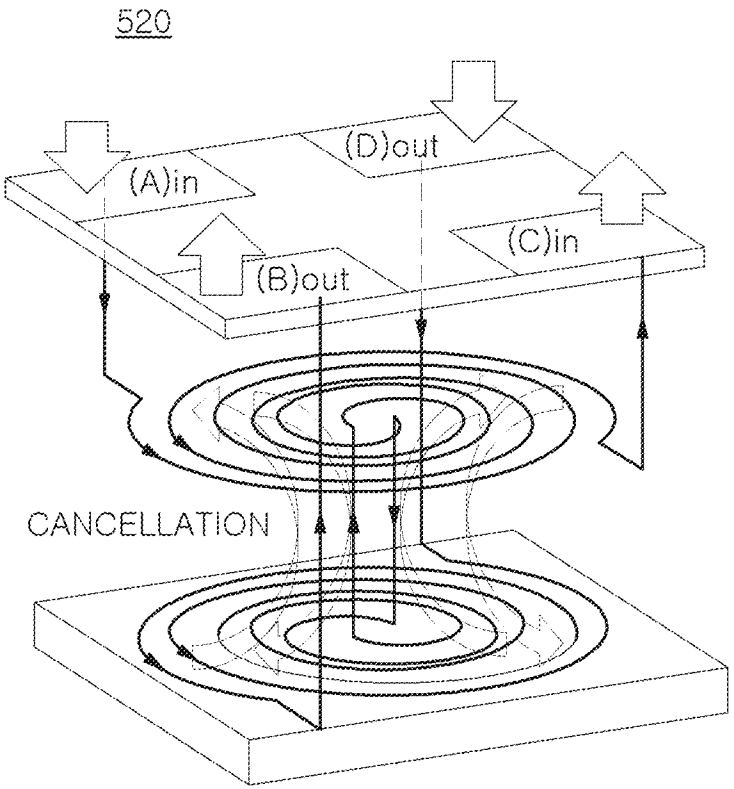
FIGS. 5A and 5B are views illustrating amplification and cancellation of a magnetic field in a common mode and a differential mode, respectively.
Figure 5A:
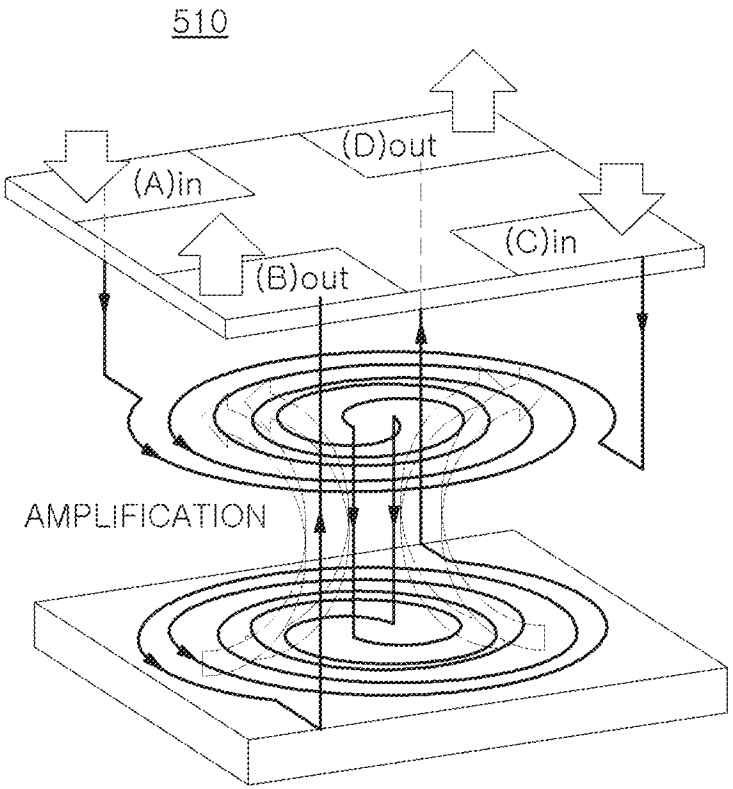

FIG. 5A is a view illustrating amplification of a magnetic field in a common mode. FIG. 5B is a view illustrating cancellation of a magnetic field in a differential mode.

As shown in FIG. 5A, in a common mode 510 operated when current directions of the two input terminals (A) in and (C) in are the same as each other, the magnetic field between an upper coil and a lower coil may be amplified and impedance L may be generated.

As described above, the common mode filter may be an element using impedance (alternating current resistance) passing a signal of a differential mode and blocking a signal of a common mode. The common mode filter may substantially block noise using impedance L. Here, the impedance L may be associated with magnetic permeability of the magnetic material. In other words, as magnetic permeability of the magnetic substrate is high, the coil may consume the amplified magnetic field, thereby improving attenuation characteristics of the common mode filter.

As shown in FIG. 5B, in a differential mode 520 operated when the current directions of the two input terminals (A) in and (C) in are opposite to each other, since the impedance L does not exist due to cancellation of the magnetic field between the upper coil and the lower coil, substantial loss hardly occurs in the coils.

Since loss of the magnetic material included in the magnetic substrate influences the common mode filter, however, attenuation efficiency may be decreased. For example, in the case of the spinel-ferrite, since magnetic permeability is sharply reduced and loss is large in the high frequency band such as a frequency band of GHz, a cancellation effect in the differential mode 520 may be reduced, and loss of the current may exist. On the other hand, since the hexaferrite particles have low loss characteristics and high magnetic permeability in the high frequency band (e.g., the frequency band of GHz) as described above, an influence of the magnetic material on the cancellation effect may be reduced even in the differential mode 520.

In other words, just using the ferrite particles (e.g., the hexaferrite particles having the plate shape, or the permanent magnet) having planar magnetic anisotropy as the magnetic material may have better attenuation characteristics in the common mode 510 and the differential mode 520 due to high magnetic permeability and low loss. Magnetic permeability and the resonance frequency may be adjusted by adjusting the size, the length, anisotropy, and the like of the ferrite particles (or the permanent magnet), thereby adjusting attenuation characteristics in the common mode 510.

Figure 6:
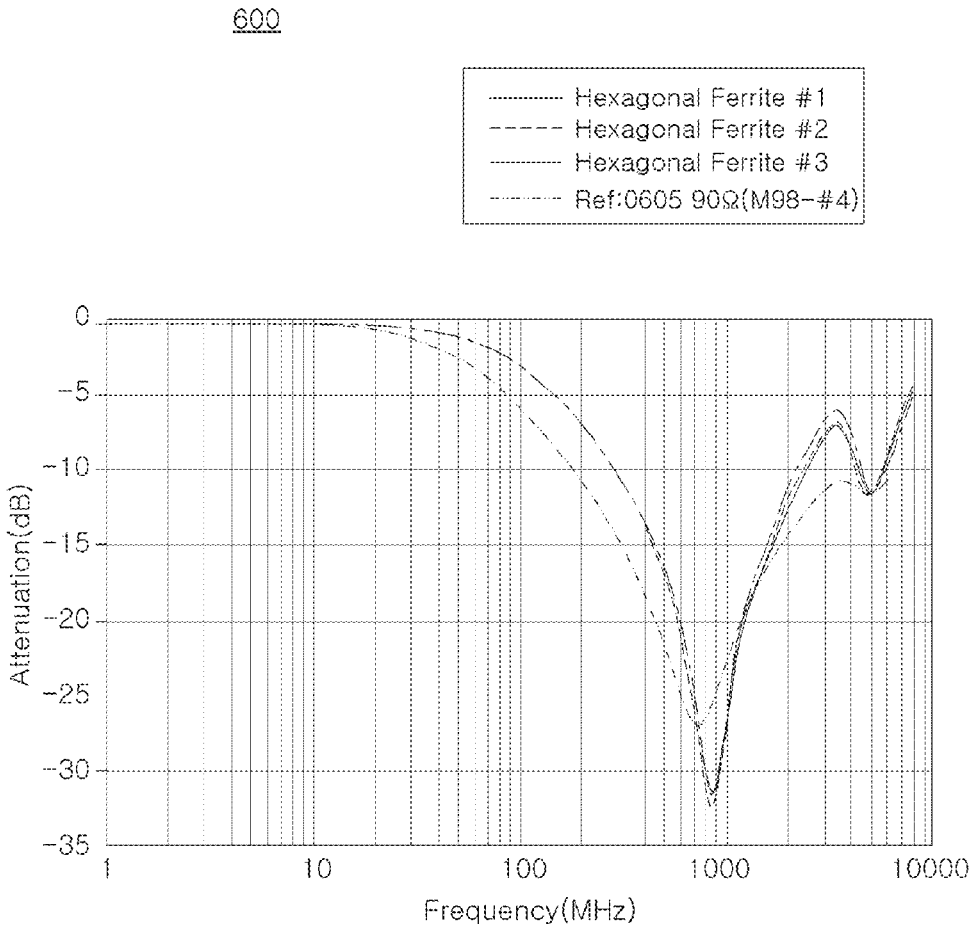
FIG. 6 is a graph illustrating an evaluation result of common mode characteristics of an element when hexaferrite particles are used, according to an exemplary embodiment in the present disclosure.

FIG. 6 is a graph illustrating an evaluation result of common mode characteristics of an element when hexaferrite particles are used, according to an exemplary embodiment in the present disclosure. An x axis of a graph 600 denotes a frequency, and a y axis denotes attenuation characteristics. Referring to the following Table 1 together with the graph 600, in a case in which the hexaferrite particles are used as the magnetic material, it may be understood that there is a common mode attenuation effect of about 3 dB as compared to a case in which a magnetic material according to the related art is used.

TABLE 1

| | Conventionally Used Material | | Hexaferrite particles | |
|---|---|---|---|---|
| | 100 MHz | 1 GHz | 100 MHz | 1 GHz |
| μ′ | 12 | 2.77 | 2.09 | 2.09 |
| Tan δ | 0.5 | 1.93 | 0.04 | 0.04 |
| Common Mode Impedance | 87.5 Ω | | 52.9 Ω | |
| Common Mode Attenuation) | −25.6 dB@0.62 GHz | | −28.4 dB@0.78 GHz | |

Figure 7:
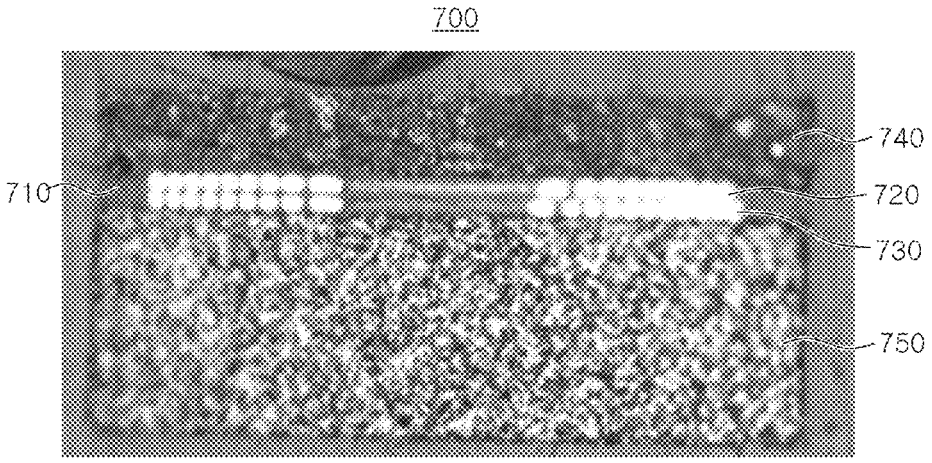
FIG. 7 is a view illustrating a photograph of a cross section of the common mode filter according to an exemplary embodiment in the present disclosure.
Figure 8:
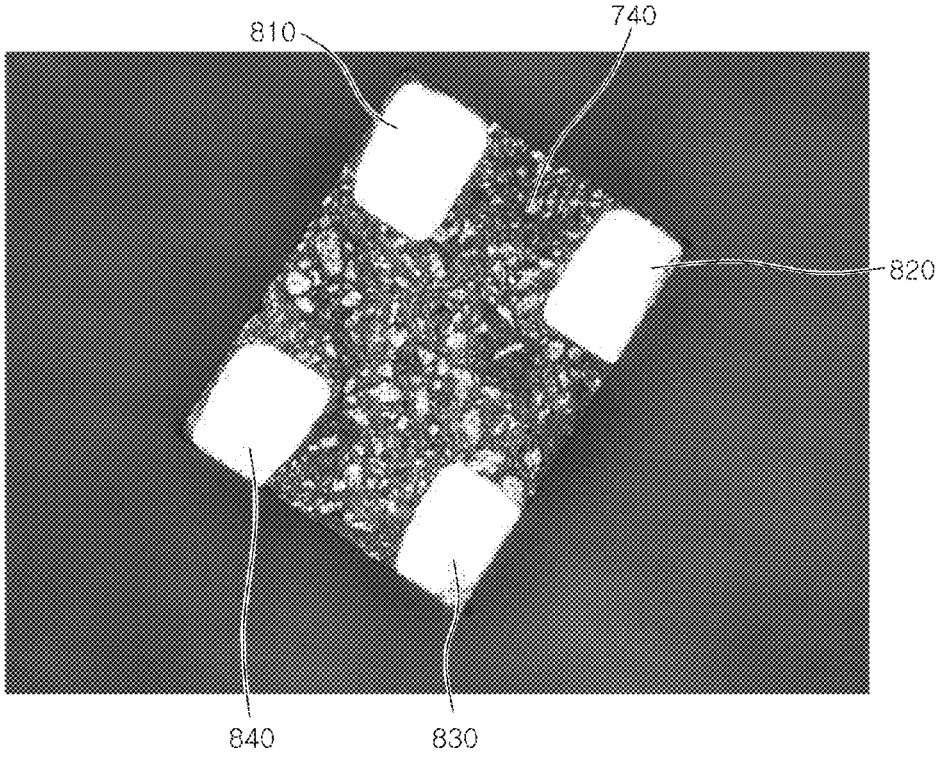
FIG. 8 is a view illustrating a photograph of atop surface of the common mode filter according to an exemplary embodiment in the present disclosure.

FIG. 7 is a view illustrating a photograph of a cross section of a common mode filter according to an exemplary embodiment in the present disclosure. FIG. 8 is a view illustrating a photograph of a top surface of the common mode filter according to an exemplary embodiment in the present disclosure.

A common mode filter 700 may include an insulating layer 710. Here, a first coil 720 and a second coil 730 may be formed in the insulating layer 710. A first magnetic substrate 740 and a second magnetic substrate 750 may be coupled to the upper and lower surfaces, respectively, of the insulating layer 710.

As described above, the ferrite particles having anisotropy may be inserted into the first magnetic substrate 740 and the second magnetic substrate 750 to have the planar structure. As an example, the ferrite particles may be formed of the hexaferrite particles having the plate shape, and the magnetic characteristics of the ferrite particles may be determined depending on the arrangement of the hexaferrite particles having the plate shape.

Two input terminals 820 and 840 and two output terminals 810 and 830 are disposed on the top of the first magnetic substrate 740 and are electrically connected to the first coil 720 and the second coil 730, such that the current may flow in the first coil 720 and the second coil 730 through four terminals 810 to 840. For example, the two input terminals 820 and 840 may be electrically connected to both ends of the first coil 720, and the two output terminals 810 and 830 may be electrically connected to both ends of the second coil 730.

In the common mode, a magnetic field generated as the current flows in the first coil 720 and the second coil 730 may be amplified, and the amplified magnetic field may flow depending on directivity of the ferrite particles included in the first magnetic substrate 740 and the second magnetic substrate 750, thereby significantly reducing radiation of the magnetic field to the outside. Since the hexaferrite particles have high magnetic permeability even in the high frequency band, when the hexaferrite particles are utilized as the ferrite particles, attenuation characteristics of the common mode filter 300 even at the high frequency may be improved.

As set forth above, according to the exemplary embodiments in the present disclosure, the common mode filter having improved attenuation characteristics in the common mode may be provided by high magnetic permeability and low loss characteristics even at the high frequency such as a frequency within the GHz band by improving high frequency characteristics using the ferrite particles having a uniform size and anisotropy with a planar structure such as hexaferrite particles.

While exemplary embodiments have been shown and described above, it will be apparent to those skilled in the art that modifications and variations could be made without departing from the scope of the present invention as defined by the appended claims.

What is claimed is:

1. A common mode filter comprising: a magnetic substrate in which ferrite particles having anisotropy and a planar structure have planar magnetic anisotropy, wherein a first portion of the magnetic substrate is coupled to an upper surface of a coil part, the ferrite particles being disposed horizontally in an upper portion of the first portion of the magnetic substrate and vertically in a lower portion of the first portion of the magnetic substrate.

2. The common mode filter of claim 1, wherein the ferrite particles include hexaferrite particles having a plate shape, and the planar magnetic anisotropy is formed depending on an arrangement of the hexaferrite particles having the plate shape.

3. The common mode filter of claim 2, wherein the hexaferrite particles have a size of 50 μm or less.

4. The common mode filter of claim 1, wherein the planar magnetic anisotropy possessed by the ferrite particles is disposed in at least one of a vertical direction and a horizontal direction of the magnetic substrate.

5. A common mode filter comprising:

a coil part including an insulating layer and a conductor pattern formed in the insulating layer; and a magnetic substrate coupled to one or both surfaces of the coil part, wherein the magnetic substrate is provided with ferrite particles having anisotropy and a planar structure, wherein a first portion of the magnetic substrate is coupled to an upper surface of the coil part, the ferrite particles being disposed horizontally in an upper portion of the first portion and vertically in a lower portion of the first portion.

6. The common mode filter of claim 5, wherein the ferrite particles have planar magnetic anisotropy.

7. The common mode filter of claim 5, wherein a second portion of the magnetic substrate is coupled to a lower surface of the coil part, and the ferrite particles being disposed horizontally in a lower portion of the second portion.

8. The common mode filter of claim 7, further including ferrite particles disposed vertically in an upper portion of the second portion.

9. A common mode filter comprising: a magnetic substrate in which a permanent magnet having anisotropy and a planar structure has planar magnetic anisotropy, wherein a first portion of the magnetic substrate is coupled to an upper surface of a coil part, the ferrite particles being disposed horizontally in an upper portion of the first portion of the magnetic substrate and vertically in a lower portion of the first portion of the magnetic substrate.

10. The common mode filter of claim 9, wherein the planar magnetic anisotropy possessed by the permanent magnet is disposed in at least one of a vertical direction and a horizontal direction of the magnetic substrate.

* * * * *